US008449066B2

(12) United States Patent
Gadke et al.

(10) Patent No.: US 8,449,066 B2
(45) Date of Patent: May 28, 2013

(54) SYSTEM AND METHOD FOR PROTECTING A PRINTER FROM AN OVER-TEMPERATURE CONDITION IN A PRINTHEAD

(75) Inventors: Christian Carl Gadke, Lake Oswego, OR (US); David L. Knierim, Wilsonville, OR (US); Lee M. Oien, Wilsonville, OR (US); Nathaniel Morrison, Tigard, OR (US); Aaron Boyce, Tigard, OR (US); Bruce Baur, Milwaukie, OR (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/364,628

(22) Filed: Feb. 2, 2012

(65) Prior Publication Data

US 2012/0133699 A1 May 31, 2012

Related U.S. Application Data

(62) Division of application No. 12/358,923, filed on Jan. 23, 2009, now Pat. No. 8,109,591.

(51) Int. Cl.
*B41J 29/38* (2006.01)

(52) U.S. Cl.
USPC ..... 347/14

(58) Field of Classification Search
USPC ..... 347/14, 19
See application file for complete search history.

(56) References Cited

U.S. PATENT DOCUMENTS

| | | | | |
|---|---|---|---|---|
| 4,980,702 | A | 12/1990 | Kneezel et al. | |
| 5,223,853 | A | 6/1993 | Wysocki et al. | |
| 5,585,825 | A | 12/1996 | Kneezel et al. | |
| 5,745,130 | A | 4/1998 | Becerra et al. | |
| 5,781,205 | A | 7/1998 | Silverbrook | |
| 5,841,449 | A | 11/1998 | Silverbrook | |
| 6,394,572 | B1 | 5/2002 | Pierce et al. | |
| 6,866,375 | B2 | 3/2005 | Leighton et al. | |
| 6,966,693 | B2 | 11/2005 | Prakash et al. | |
| 7,182,448 | B2 | 2/2007 | Godil et al. | |
| 7,219,418 | B2 | 5/2007 | Byrd | |
| 7,870,299 | B1 * | 1/2011 | Sorensen et al. | 710/2 |
| 2004/0239711 | A1 | 12/2004 | Koehler et al. | |
| 2005/0140713 | A1 | 6/2005 | Godil et al. | |
| 2006/0284915 | A1 | 12/2006 | Han | |

FOREIGN PATENT DOCUMENTS

| | | |
|---|---|---|
| EP | 1366900 | 12/2003 |
| JP | 63268667 | 11/1988 |

OTHER PUBLICATIONS

EP Search Report corresponding to European Patent Application 10151299, European Patent Office, Munich Germany, May 6, 2010 (7 pages).

* cited by examiner

*Primary Examiner* — Laura Martin
(74) *Attorney, Agent, or Firm* — Maginot, Moore & Beck, LLP

(57) ABSTRACT

A method responds to an over-temperature condition in a printhead. The method includes generating a first electrical signal corresponding to a temperature in a printhead, monitoring the first electrical signal with a first electronic circuit to terminate delivery of electrical power to a printhead in response to detection of a safety event, and monitoring the first electrical signal with a second electronic circuit to regulate an amount of electrical power delivered to the printhead.

20 Claims, 3 Drawing Sheets

SYSTEM AND METHOD FOR PROTECTING A PRINTER FROM AN OVER-TEMPERATURE CONDITION IN A PRINTHEAD

PRIORITY CLAIM

This application is a divisional application of and claims priority to U.S. application Ser. No. 12/358,923, which was filed on Jan. 23, 2009, is entitled "System And Method For Protecting A Printer From An Over-Temperature Condition In A Printhead," and which will issue as U.S. Pat. No. 8,109,591 on Feb. 7, 2012.

TECHNICAL FIELD

This disclosure relates generally to ink jet printers, and in particular, to ink jet printers having printheads with heaters for the thermal treatment of ink.

BACKGROUND

Solid ink or phase change ink printers conventionally receive ink in a solid form, either as pellets or as ink sticks. The solid ink pellets or ink sticks are typically inserted through an opening of an ink loader for the printer, and the ink sticks are pushed along the feed channel by a feed mechanism and/or move under the effects of gravity toward a heater plate in a heater assembly. The heater plate melts the solid ink impinging on the plate into a liquid that is delivered to a melt reservoir. The melt reservoir is configured to maintain a quantity of melted ink in liquid or melted form and to communicate the melted ink to a reservoir in one or more printheads as needed.

Within the printheads, heaters maintain the ink in the printhead reservoirs and jetstacks in liquid form. These heaters are usually energized with AC power from the 115/230 VAC RMS mains of a facility's power grid. The AC power is regulated using semiconductor triac switches. Because the heaters are connected to the input AC power mains, they typically meet UL, CSA, and manufacturer safety requirements for construction. In the event of a fault condition, manufacturers typically require that the heater construction be able to pass an appropriate safety standard, such as a 1,500 VRMS hi-pot withstand test for a single insulated constructed heater or a 3,000 VRMS hi-pot withstand test for a double insulated constructed heater, for a one-minute interval even after a "thermal runaway" fault condition. Thermal runaway is described as the loss of input AC power regulation that results in AC power being continuously applied to the heaters. The loss of input AC power regulation normally occurs in response to a failed semiconductor triac switch shorting in a manner that directly couples AC power to the heater. The continuous application of input power causes the heaters to heat until they either burn open or an in-line thermal fuse disconnects the AC power from the heaters.

The in-line thermal fuses address the thermal runaway condition by sensing the heater temperature and disconnecting the input power from the heater in response to the heater temperature rising above the threshold temperature of the fuse. The decoupling of the input power from the heater helps avoid damage to the heater. Manufacturers typically require that a heater be able to pass one of the withstand tests after a thermal runaway event. In order to achieve this goal, the thermal fuse should respond before the ability of the heater to pass the withstand test is degraded. Providing timely responses to thermal runaway events is a desirable goal in solid ink printers.

SUMMARY

A method has been developed that detects and responds to an over-temperature condition in a printhead to protect the printer from a runaway thermal condition with reference to the same signal used to regulate the delivery of electrical power to a printhead. The method includes generating a first electrical signal corresponding to a temperature in a printhead, monitoring the first electrical signal with a first electronic circuit to terminate delivery of electrical power to a printhead in response to detection of a safety event, and monitoring the first electrical signal with a second electronic circuit to regulate an amount of electrical power delivered to the printhead.

A system detects and responds to an over-temperature condition with reference to the same signal used to regulate the delivery of electrical power to a printhead within a printer. The system includes a first electronic circuit configured to monitor a first electrical signal and terminate delivery of electrical power to a printhead in response to the first electronic circuit detecting a safety event, and a second electronic circuit configured to monitor the first electrical signal and regulate an amount of electrical power delivered to the printhead.

DETAILED DESCRIPTION OF THE PREFERRED EMBODIMENT

Figure 1:
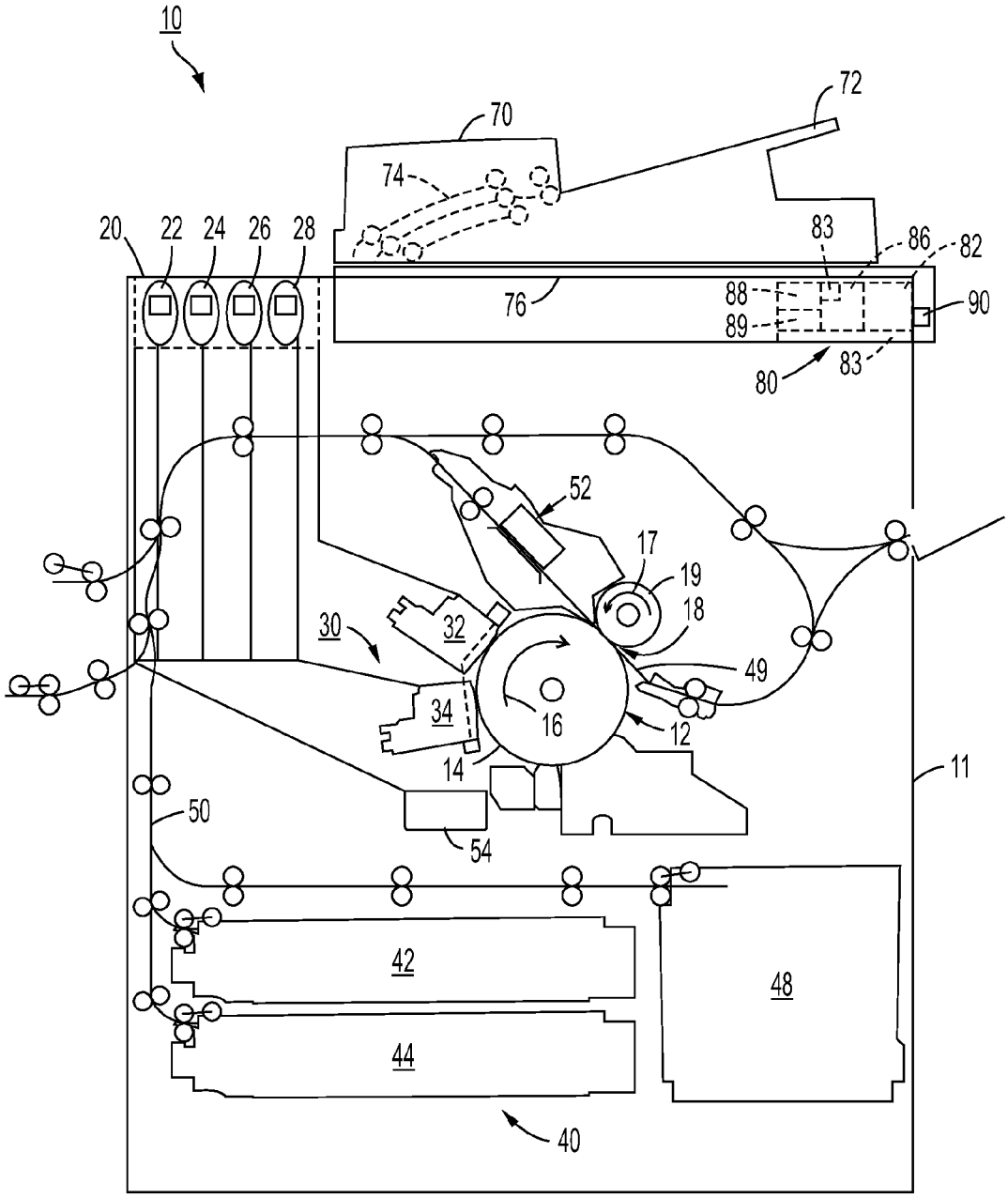
FIG. 1 is block diagram of a phase change ink image producing machine.

For a general understanding of the system disclosed herein as well as the details for the system and method, reference is made to the drawings. In the drawings, like reference numerals have been used throughout to designate like elements. As used herein, the word "printer," "imaging device," "image producing machine," encompasses any apparatus that performs a print outputting function for any purpose, such as a digital copier, bookmaking machine, facsimile machine, a multi-function machine, or the like.

Referring now to FIG. 1, an embodiment of an image producing machine, such as a high-speed phase change ink image producing machine or printer 10, is depicted. As illustrated, the machine 10 includes a frame 11 to which are mounted directly or indirectly all its operating subsystems and components, as described below. To start, the high-speed phase change ink image producing machine or printer 10 includes an imaging member 12 that is shown in the form of a drum, but can equally be in the form of a supported endless belt. The imaging member 12 has an imaging surface 14 that is movable in the direction 16, and on which phase change ink images are formed. A heated transfix roller 19 rotatable in the direction 17 is loaded against the surface 14 of drum 12 to form a transfix nip 18, within which ink images formed on the surface 14 are transfixed onto a heated copy sheet 49.

The high-speed phase change ink image producing machine or printer 10 also includes a phase change ink delivery subsystem 20 that has at least one source 22 of one color phase change ink in solid form. Since the phase change ink image producing machine or printer 10 is a multicolor image producing machine, the ink delivery system 20 includes four (4) sources 22, 24, 26, 28, representing four (4) different colors CYMK (cyan, yellow, magenta, black) of phase change inks. The phase change ink delivery system also includes a melting and control apparatus (not shown) for melting or phase changing the solid form of the phase change ink into a liquid form. The phase change ink delivery system is suitable for then supplying the liquid form to a printhead system 30 including at least one printhead assembly 32. Since the phase change ink image producing machine or printer 10 is a high-speed, or high throughput, multicolor image producing machine, the printhead system 30 includes multicolor ink printhead assemblies and a plural number (e.g. four (4)) of separate printhead assemblies 32, 34, 36, and 38 as shown.

As further shown, the phase change ink image producing machine or printer 10 includes a substrate supply and handling system 40. The substrate supply and handling system 40, for example, may include sheet or substrate supply sources 42, 44, 46, 48, of which supply source 48, for example, is a high capacity paper supply or feeder for storing and supplying image receiving substrates in the form of cut sheets 49, for example. The substrate supply and handling system 40 also includes a substrate handling and treatment system 50 that has a substrate heater or pre-heater assembly 52. The phase change ink image producing machine or printer 10 as shown may also include an original document feeder 70 that has a document holding tray 72, document sheet feeding and retrieval devices 74, and a document exposure and scanning system 76.

Operation and control of the various subsystems, components and functions of the machine or printer 10 are performed with the aid of a controller or electronic subsystem (ESS) 80. The ESS or controller 80, for example, is a self-contained, dedicated mini-computer having a central processor unit (CPU) 82, electronic storage 84, and a display or user interface (UI) 86. The ESS or controller 80, for example, includes a sensor input and control circuit 88 as well as a pixel placement and control circuit 89. In addition, the CPU 82 reads, captures, prepares and manages the image data flow between image input sources such as the scanning system 76, or an online or a work station connection 90, and the printhead assemblies 32, 34, 36, 38. As such, the ESS or controller 80 is the main multi-tasking processor for operating and controlling all of the other machine subsystems and functions, including the printhead cleaning apparatus and method discussed below.

In operation, image data for an image to be produced are sent to the controller 80 from either the scanning system 76 or via the online or work station connection 90 for processing and output to the printhead assemblies 32, 34, 36, 38. Additionally, the controller determines and/or accepts related subsystem and component controls, for example, from operator inputs via the user interface 86, and accordingly executes such controls. As a result, appropriate color solid forms of phase change ink are melted and delivered to the printhead assemblies. Additionally, pixel placement control is exercised relative to the imaging surface 14 thus forming desired images per such image data, and receiving substrates are supplied by any one of the sources 42, 44, 46, 48 and handled by substrate system 50 in timed registration with image formation on the surface 14. Finally, the image is transferred from the surface 14 and fixedly fused to the copy sheet within the transfix nip 18.

Figure 2:
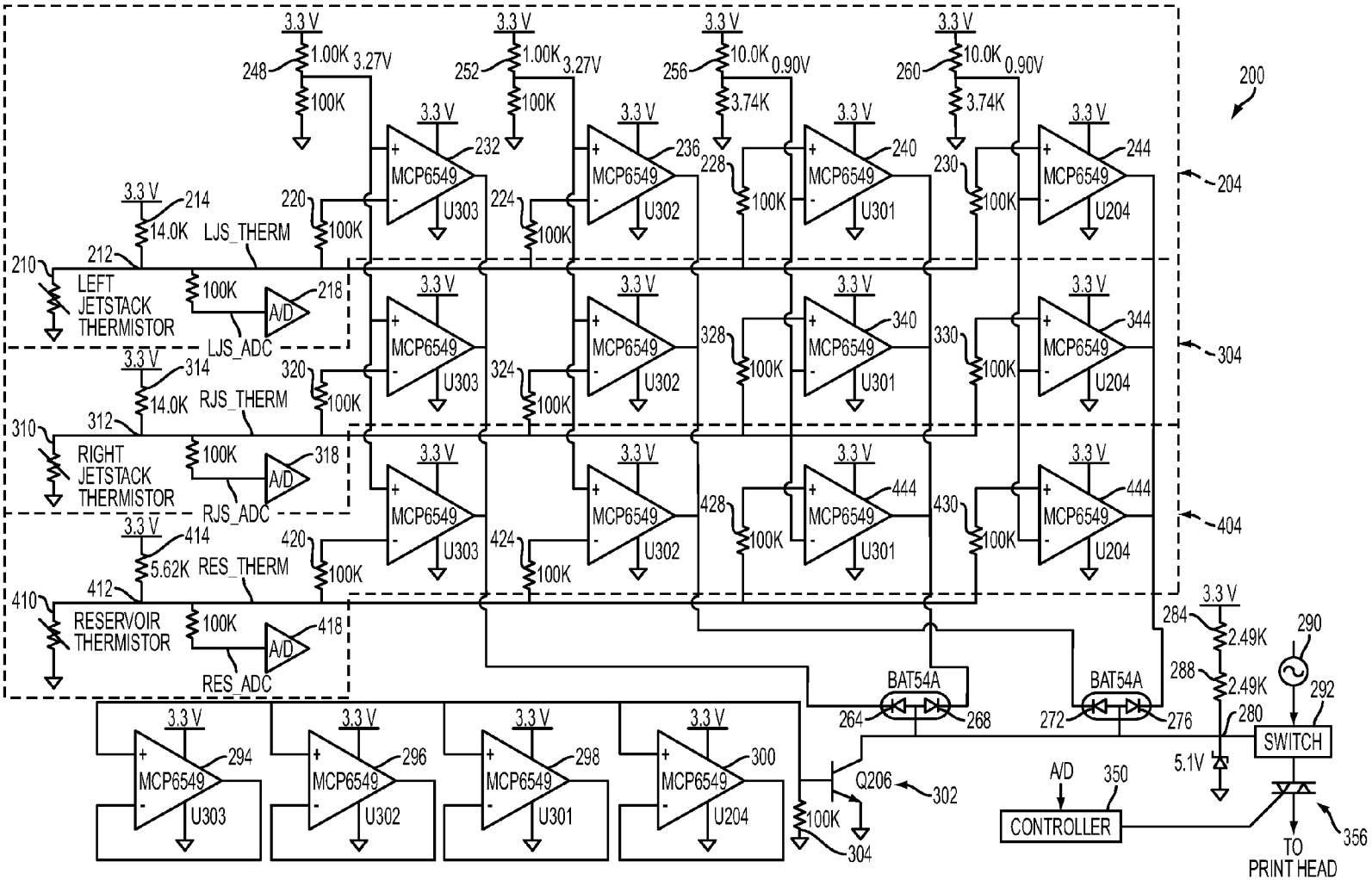
FIG. 2 is an electrical schematic of a circuit that sensing temperature conditions in a printhead of a solid ink printer and responds to over-temperature conditions to de-coupled heaters in the printhead from electrical power.

A circuit 200 that helps protect a printhead from runaway thermal conditions is shown in FIG. 2. The circuit 200 is comprised of a left jetstack circuit 204, a right jetstack circuit 304, and an ink reservoir 404 circuit. Each of these circuits has a structure that is essentially the same as the other two circuits. Therefore, only the left jetstack circuit 204 is described herein to simplify the description. Within each circuit, reference numbers for similar components end in the same two digits.

Left jetstack thermistor 210 is mounted in a printhead within a printer at a position that corresponds with the temperature of the left side of a jetstack within the printhead. In the embodiment shown, the thermistor is a negative coefficient thermistor, which means the electrical resistance of the thermistor decreases with increasing temperature. A voltage source (not shown) provides a voltage that is dropped across resistor 214 and across thermistor 210 to ground. Consequently, the voltage at node 212 corresponds to a temperature of a left jetstack in the printhead. This signal changes as the resistance of thermistor 210 is altered by changing temperatures at the left jetstack.

The signal may be converted by analog/digital converter (ADC) 218 to a digital value that may be input to a controller 350 of the printer. The digital output of ADCs 318 and 418 may be multiplexed with the output of ADC 218 to provide three channels of temperature data to a controller or each digital signal may be continuously provided to a controller. In the embodiment of FIG. 2, the signal from a single sensor, namely, one of the thermistors 210, 310, or 410 may be used as both a temperature regulation control signal by the controller 350 and as a safety condition signal by the circuit 200. Temperature regulation control is performed by controller 350 using the temperature corresponding to the digital value of the voltage received from a thermistor to generate a control signal for triac 356. The control signal selectively operates triac 356 with a varying signal to regulate the amount of electrical power received from a source 290 through switch 292 to one or more heaters in the printhead. Thus, the analog signal is converted to a digital signal that is processed by the controller 350 to regulate power delivery to the printhead during operational modes. This analog signal is also processed by circuit 200 to operate the switch 292 to terminate the delivery of power to the printhead in the event of a safety event occurring as is now explained.

The analog signal from thermistor 210 is provided through input resistors 220, 224, 228, and 230 to four electronic circuits, which in FIG. 2 are implemented with comparators 232, 236, 240, and 244. The signal is provided to the inverting input of comparators 232 and 236 and to the non-inverting input of comparators 240 and 244. The non-inverting inputs of the comparators 232 and 236 are coupled to a reference signal provided by, for example, a voltage divider, such as voltage dividers 248 and 252. The inverting inputs of comparators 240 and 244 are coupled to a reference signal provided by, for example, a voltage divider, such as voltage dividers 256 and 260. The resistors of voltage dividers 248 and 252 are sized to generate a reference signal that is greater than the reference signal provided by voltage dividers 256 and 260. In the embodiment shown, the reference signals from voltage dividers 248 and 252 correspond to an open circuit threshold and the reference signals from voltage dividers 256 and 260 correspond to a temperature threshold indicative of an over-temperature condition. Although the signals from dividers 248 and 252 are approximately equal to one another and the signals from dividers 256 and 260 are approximately equal to one another, the reference signals to redundant comparators need not be equal.

The outputs of comparators 232 and 236 are coupled to node 280 through diodes 264 and 272, while the outputs of comparators 240 and 244 are coupled to node 280 through the diodes 268 and 276. As shown in FIG. 2, the outputs of the comparators 232, 236, 240, and 244 are open collector outputs. Thus, the output transistors of the comparators are activated in response to the signal at node 212 being greater than the reference signal from the dividers 248 and 252 and in response to the signal at node 212 being less than the reference signal from the dividers 256 and 260. When an output transistor of one of the comparators is turned on, the voltage dropped across resistors 284 and 288 at node 280 is pulled to ground through the output stage of the activated comparator. Otherwise, this voltage is provided to the switch 292. As long as a positive voltage is present at node 280, the switch 292 provides power from an AC power source 290 to a heater in the printhead. In response to the voltage at the node 280 being pulled to ground through the output stage of a comparator, the switch decouples power from the heater in the printhead.

In the circuit shown in FIG. 2, the comparators 232, 236, 240, and 244 are on different substrates. That is, each comparator is an integrated circuit (IC) that is separately packaged from the integrated circuits (ICs) used to implement the other comparators. This enables the electronic circuits of the left side jetstack to be electrically independent of one another. Thus, comparators 232 and 236 are redundant electronic circuits for generating an open circuit signal, while comparators 240 and 244 are redundant electronic circuits for generating an over-temperature signal. In the circuit of FIG. 2, the comparators depicting as being in a column with one of the comparators 232, 236, 240, and 244 are implemented with integrated electronic circuits on the same substrate as the comparator in the left side jetstack circuit. Each of the comparators 294, 296, 298, and 300 are located on one of the four substrates on which the electronic circuits are implemented. They are configured to generate a signal indicative of a catastrophic failure of the integrated circuits on the substrate and turn on transistor 302 to ground the voltage at the node 280 through the transistor 302 and decouple power from the heater in the printhead.

In operation, the circuit 200 is powered to generate a signal corresponding to temperature at each position in the printhead where a thermistor is mounted. These signals are provided to four comparators with each pair of comparators operating as redundant circuits to the other circuit in the pair. The temperature signal is compared by two of the comparators to an open circuit reference electrical signal and compared by another two of the comparators to an over-temperature reference electrical signal. Should the temperature signal equal or fall below the over-temperature reference signal, the output stage of the comparator is activated, the voltage at node 280 is grounded, and the switch 292 decouples a heater in the printhead from electrical power. Should the temperature signal equal or exceed the open circuit reference signal, the output stage of the comparator is activated, the voltage at node 280 is grounded, and the switch 292 decouples a heater in the printhead from electrical power.

The group of comparators 294, 296, 298, and 300 are configured to detect ground pin faults on the integrated circuits (substrates) that are used to implement the circuit 200. In the event that an IC implementing one of the electronic circuits in circuit 200 is no longer electrically grounded, a voltage appears on the non-inverting input of the comparator 294, 296, 298, or 300 in the integrated circuit that is no longer grounded. This voltage is an open ground signal and is dropped across resistor 304 to turn on transistor 302. In response, transistor 302 grounds the voltage at the node 280 and causes switch 292 to decouple power from the heater in the printhead.

The description of a circuit that enables the signal from a single temperature sensor to be used for both safety and temperature regulation functions comports with the circuit embodiment shown in FIG. 2. Other circuit embodiments may be used. For example, if positive temperature coefficient thermistors are used to generate temperature signals, the inputs on the comparators and the reference signals may be adapted accordingly to detect over temperature and open circuit conditions and decouple electrical power from a heater in the printhead.

Figure 3:
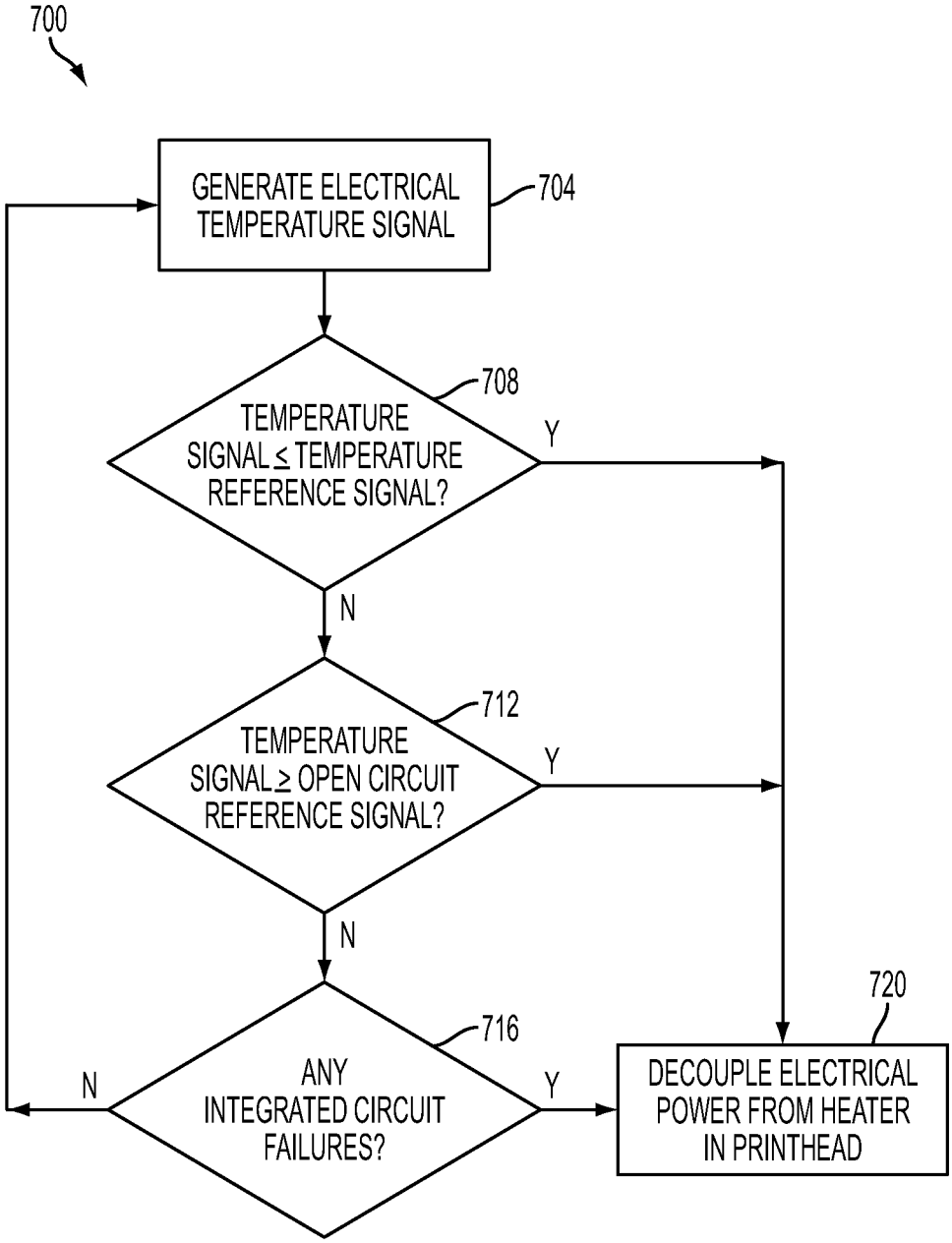
FIG. 3 is a flow diagram for a process of responding to over-temperature conditions in a printhead of the imaging device of FIG. 1 by de-coupling the heaters in the printhead from electrical power.

An exemplary process implemented by the circuit in FIG. 2 is shown in FIG. 3. The process 700 monitors the temperature of a printhead and responds to an over-temperature condition by de-coupling the heaters in the printhead from an electrical power source. The process begins with generation of a electrical temperature signal corresponding to a position within a printhead (block 704). The temperature signal is compared to an over-temperature reference signal (block 708), an open circuit reference signal (block 712), and a catastrophic failure threshold (block 716). If any one of these conditions is active, electrical power is decoupled from a heater in the printhead (block 720). Otherwise, the process continues generating a temperature signal and comparing that signal to the reference signals and threshold to detect a condition requiring decoupling of electrical power from a heater in the printhead.

The comparisons of the temperature signal to the two reference signals may also include redundant comparisons using electronic circuits to help ensure detection of an over-temperature or open circuit condition similar to those described above. The term "electronic circuits" refers to electrical circuits that are implemented with both active semiconductor components, such as transistors and comparators, and passive components, such as resistors, inductors, and capacitors.

The system and method described above provide a circuit that monitors a signal corresponding to a temperature for both safety and power regulation. Although the system and method are described with reference to a heater within a printhead, the circuit may be used with other types of heaters. Typically, standard thermal cut-outs, such as fuses, thermal links, or the like, are cost effective for most heaters. In environments where the heater is located in a constrained space and a very fast thermal response time is required, a circuit, such as the one described above, may be used. In such a circuit, the thermistor is positioned to generate a signal corresponding to a temperature in the structure heated by the heater and the sensing circuits are configured as described above to monitor the signal for the regulation of power to the heater and for termination of electrical power to the heater in the event of a safety fault, such as an open ground condition or an over temperature condition.

Those skilled in the art will recognize that numerous modifications can be made to the specific implementations of the thermal runaway responsive methods and systems described above. Therefore, it will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A method of controlling delivery of electrical power to a printhead in a printer comprising:

generating a first electrical signal corresponding to a temperature in a printhead;

monitoring the first electrical signal with a first electronic circuit that terminates delivery of electrical power to a printhead in response to detection of a safety event; and monitoring the first electrical signal with a second electronic circuit that regulates an amount of electrical power delivered to the printhead, the second electronic circuit being electrically independent of the first electronic circuit.

2. The method of claim 1, the termination of electrical power to the printhead further comprising:

generating an over-temperature signal with the first electronic circuit in response to the temperature corresponding to the first electrical signal exceeding a temperature threshold; and decoupling electrical power from the printhead in response to the generation of the over-temperature signal.

3. The method of claim 2 further comprising:

monitoring the first electrical signal with a third electronic circuit that is electrically independent of the first electronic circuit and the second electronic circuit;

generating an over-temperature signal with the third electronic circuit in response to the temperature corresponding to the first electrical signal exceeding a temperature threshold, the first and the third electronic circuits being implemented with different integrated circuits that are located on different substrates independent from one another; and decoupling electrical power from the printhead in response to the generation of the over-temperature signal.

4. The method of claim 1, the termination of electrical power to the printhead further comprising:

generating a circuit fault signal with the first electronic circuit in response to the first electrical signal exceeding a first reference signal; and decoupling electrical power from the printhead in response to the generation of the circuit fault signal.

5. The method of claim 4 further comprising:

monitoring the first electrical signal with a third electronic circuit that is electrically independent from the first electronic circuit and the second electronic circuit;

generating a circuit fault signal with the third electronic circuit in response to the first electrical signal exceeding a second reference signal, the first and the third electronic circuits being implemented with different integrated circuits that are located on different substrates that are independent from one another; and decoupling electrical power from the printhead in response to the generation of the circuit fault signal.

6. The method of claim 1, the termination of electrical power to the printhead further comprising:

generating an open ground signal in response to detection of electrical ground loss in the integrated circuit implementing the first electronic circuit; and decoupling electrical power from the printhead in response to the generation of the open ground signal.

7. The method of claim 2 further comprising:

generating a circuit fault signal with a third electronic circuit in response to the first electrical signal exceeding a reference signal, the third electronic circuit being electrically independent of the first electronic circuit and the second electronic circuit; and decoupling electrical power from the printhead in response to the generation of the circuit fault signal.

8. The method of claim 7 wherein the first and the third electronic circuits are implemented with different integrated circuits that are located on different substrates that are independent of one another, and the method further comprising:

generating an open ground signal in response to detection of electrical ground loss in one of the integrated circuits implementing the first and the third electronic circuits; and decoupling electrical power from the printhead in response to the generation of the open ground signal.

9. The method of claim 7 further comprising:

monitoring the first electrical signal with a fourth and a fifth electronic circuit;

generating an over-temperature signal with the fourth electronic circuit in response to the temperature corresponding to the first electrical signal exceeding a temperature threshold, the first and the fourth electronic circuits being implemented with different integrated circuits that are located on different substrates that are independent of one another;

generating a circuit fault signal with the fifth circuit in response to the temperature corresponding to the first electrical signal being greater than a second reference signal, the second and the fifth electronic circuits being implemented with different integrated circuits that are located on different substrates that are independent of one another; and decoupling electrical power from the printhead in response to the generation of the over-temperature signal or the circuit fault signal.

10. A system for monitoring electrical power delivered to a printhead within a printer comprising:

a first electronic circuit configured to monitor a first electrical signal and terminate delivery of electrical power to a printhead in response to the first electronic circuit detecting a safety event; and a second electronic circuit that is electrically independent of the first electronic circuit and configured to monitor the first electrical signal and regulate an amount of electrical power delivered to the printhead.

11. The system of claim 10 wherein the first electronic circuit is configured to compare the first electrical signal to a first reference signal and generate an over-temperature signal in response to the temperature corresponding to the first electrical signal exceeding a temperature threshold corresponding to the first reference signal; and the system further comprising:

a switch coupled to the first electronic circuit and configured to decouple electrical power from the printhead in response to the over-temperature signal.

12. The system of claim 10 wherein the first electronic circuit is configured to compare the first electrical signal to a first reference signal and generate a circuit fault signal in response to the first electrical signal exceeding the first reference signal; and the system further comprising:

a switch coupled to the first electronic circuit and configured to decouple electrical power from the printhead in response to the circuit fault signal.

13. The system of claim 11 further comprising:

a third electronic circuit electrically independent of the first electronic circuit and the second electronic circuit, the third electronic circuit being configured to compare the first electrical signal to a second reference signal and generate a circuit fault signal in response to the first electrical signal exceeding the second reference signal; and a switch coupled to the first and third electronic circuit and configured to decouple electrical power from the printhead in response to either one of the over-temperature signal and the circuit fault signal.

14. The system of claim 11 further comprising:

a third electronic circuit electrically independent of the first electronic circuit and the second electronic circuit, the third electronic circuit being configured to compare the first electrical signal to a second reference signal and generate the over-temperature signal in response to the temperature corresponding to the first electrical signal exceeding a temperature threshold corresponding to the second reference signal, the first and the third electronic circuits being implemented with different integrated circuits located on different substrates that are independent of one another; and a switch coupled to the first and the third electronic circuits and configured to decouple electrical power from the printhead in response to the over-temperature signal.

15. The system of claim 12 further comprising:

a third electronic circuit electrically independent of the first electronic circuit and the second electronic circuit, the third electronic circuit being configured to compare the first electrical signal to a second reference signal and generate the circuit fault signal in response to the temperature corresponding to the first electrical signal exceeding a temperature threshold corresponding to the second reference signal, the first and the third electronic circuits being implemented with different integrated circuits located on different substrates that are independent of one another; and a switch coupled to the first and the third electronic circuits and configured to decouple electrical power from the printhead in response to the over-temperature signal.

16. The system of claim 10 further comprising:

a third electronic circuit electrically independent of the first electronic circuit and the second electronic circuit, the third electronic circuit being configured to generate an open ground signal in response to detection of electrical ground loss in an integrated circuit implementing the first electronic circuit; and a switch coupled to the first and the third electronic circuits and configured to decouple electrical power from the printhead in response to either one of the first circuit detecting a safety event and the third electronic circuit generating the open ground signal.

17. The system of claim 10 further comprising:

a third electronic circuit electrically independent of the first electronic circuit and the second electronic circuit, the third electronic circuit being configured to monitor the first electrical signal and terminate delivery of electrical power to a printhead in response to the third electronic circuit detecting a safety event, the first and the third electronic circuits being implemented with different integrated circuits; and a switch coupled to the first and the third electronic circuits and configured to decouple electrical power from the printhead in response to either one of the first electronic circuit and the third electronic circuit detecting a safety event.

18. The system of claim 17 wherein the first and the third electronic circuits detect different safety events.

19. The system of claim 17 wherein the first and the third electronic circuits detect the same safety event.

20. The system of claim 17 further comprising:

a fourth electronic circuit electrically independent of the first electronic circuit, the second electronic circuit, and the third electronic circuit, the third electronic circuit being configured to generate an open ground signal in response to detection of electrical ground loss in one of the integrated circuits implementing the first and the third electronic circuits; and the switch is coupled to the first, the third, and the fourth electronic circuits and configured to decouple electrical power from the printhead in response to any one of the first electronic circuit and the third electronic circuit detecting a safety event, and the fourth electronic circuit generating the open ground signal.

* * * * *